US006000141A

United States Patent [19]

Afshari

[11] Patent Number: 6,000,141

[45] Date of Patent: Dec. 14, 1999

[54] ARCHERY BOW SIGHT

[75] Inventor: Abbas Ben Afshari, Pocatello, Id.

[73] Assignee: Scout Mountain Equipment, Inc., Pocatello, Id.

[21] Appl. No.: 08/995,053

[22] Filed: Dec. 19, 1997

[51] Int. Cl.[6] ..... F41G 1/467

[52] U.S. Cl. ..... 33/265

[58] Field of Search ..... 33/265; 124/87

[56] References Cited

U.S. PATENT DOCUMENTS

| | | | |
|---|---|---|---|
| 3,163,938 | 1/1965 | Reynolds | 33/265 |
| 3,310,875 | 3/1967 | Kowalski | 33/265 |
| 3,696,517 | 10/1972 | Larson | 33/265 |
| 3,766,656 | 10/1973 | Westphal | 33/265 |
| 3,864,836 | 2/1975 | Haines | 33/265 |
| 4,136,462 | 1/1979 | Topel | 33/265 |
| 4,305,208 | 12/1981 | Larson | 33/265 |
| 4,535,747 | 8/1985 | Kudlacek | 124/87 |
| 4,625,421 | 12/1986 | Strauss | 33/265 |
| 4,757,614 | 7/1988 | Kudlacek | 33/265 |
| 4,813,150 | 3/1989 | Colvin | 33/265 |
| 4,819,611 | 4/1989 | Sappington | 33/265 |
| 4,910,874 | 3/1990 | Busch | 124/87 |
| 4,928,394 | 5/1990 | Sherman | 33/265 |
| 4,982,503 | 1/1991 | Land | 33/265 |
| 5,201,124 | 4/1993 | Sherman | 33/265 |
| 5,231,765 | 8/1993 | Sherman | 33/265 |
| 5,239,760 | 8/1993 | Dixon et al. | 33/265 |
| 5,442,861 | 8/1995 | Lorocco | 124/87 |
| 5,509,401 | 4/1996 | Trubic | 124/87 |
| 5,649,526 | 7/1997 | Ellig | 124/87 |
| 5,685,081 | 11/1997 | Winegar | 33/265 |

FOREIGN PATENT DOCUMENTS

| | | | |
|---|---|---|---|
| 1026490 | 4/1966 | United Kingdom | 33/265 |

OTHER PUBLICATIONS

Scout Mountain Equipment, "1996 Product Catalog," (all).

*Primary Examiner*—G. Bradley Bennett

*Attorney, Agent, or Firm*—Moriss Bateman O'Bryant & Compagni

[57] ABSTRACT

An archery sight for a bow comprises an integral pin plate, pin guard and windage adjustment structure. In a preferred embodiment, the pin plate is configured to maintain the sight pins in substantially parallel arrangement relative to one another. In another preferred embodiment, the pin plate defines a plurality of elongate apertures, each for securing a sight pin to the pin plate. Accordingly, the sight pins can pivot relative to the pin plate allowing for closer arrangement of the tips of the sight pins than would otherwise be allowable if the pins were maintained in a parallel relationship. In yet another preferred embodiment, the archery sight is comprised of an integrated pin plate, pin guard, and adjustable windage mechanism. In still another preferred embodiment, the archery sight comprises at least one two-headed sight pin preferably having sight heads of different widths. In yet another preferred embodiment, a support post on tab extends from the sight pin for supporting a portion of a fiber optic segment attached thereto.

22 Claims, 12 Drawing Sheets

ARCHERY BOW SIGHT

BACKGROUND OF THE INVENTION

This invention relates generally to archery bow sights and, more specifically, to an archery bow sight which includes one or more sight pins securable thereto, the archery bow sight being mountable to an archery bow in a manner that allows gang movement of one or more sight pins relative to the bow.

Archery bow sights utilizing a plurality of sight pins have been known in the art for many years. Typically, these sights utilize a bracket or other mounting structure for mounting the sight to a bow. The sight is commonly comprised of a pin plate, a pin guard, and a plurality of sight pins securable to the pin plate. The sight is mounted to a bow in a manner so that when the bow is drawn, the archer can look through a peep sight provided in the bow cable and align the tip of a pin attached to the sight with a target. For sights utilizing a plurality of sight pins having their tips vertically aligned, each individual sight pin is typically provided for aiming the bow at a target at a particular distance from the archer. For example, one pin may be positioned in the sight for aiming the bow at a target 50 yards from the archer while another pin may be positioned for a target that is at 100 yards.

In addition to providing individual pin adjustment relative to the sight, many prior art archery sights are mounted to the bow in a manner that allows group or what is commonly termed "gang" adjustment of the pins. Such adjustment is useful when the individual pins are properly positioned for a particular type or weight of arrow and shooting of a another type or weight of arrow effects the flight path. For example, for an arrow having a different quill arrangement or configuration, the pin sights may be properly positioned to account for targets at the various distances, but the flight path may be affected to the left or to the right (commonly referred to as "windage"). In such a situation, it may be desirable to move the entire sight to the left or the right without repositioning the individual sight pins. There are two common types of sight windage adjustment mechanisms for archery bow sights, two point and single point. For two point adjustment, the sight is typically secured to its mounting bracket at two points and may be adjusted to the left or right by loosening fasteners at these two points. With a single point adjustment sight, the sight is typically secured to a mounting bracket by a single fastener arrangement and thus can be adjusted relative to the mounting bracket by loosening of the single fastener arrangement. Similar adjustment mechanisms have been provided in the art for providing gang adjustability of the entire sight in a vertical direction.

While the basic concept of securing a plurality of pins to a pin plate is known in the art, various techniques to accomplish this have been employed. For example, in U.S. Pat. No. 4,910,874 to Busch the sight pins are provided with external threads and are inserted through a longitudinally extending slot in the pin plate. An internally threaded fastener is threaded onto the sight pin in order to secure it to the pin plate. The tips of the sight pins thus extend into the sight window defined by the pin plate and the guard. By properly aligning the sight pins relative to the pin plate and the sight relative to the bow, the archer may utilize each sight pin for a target at a particular distance.

Such an arrangement of sight pins, however, necessarily limits the distance between adjacent tips of sight pins by the smallest transverse dimension of the structure securing the sight pin to the pin plate. For example, in the Busch patent previously discussed, the tips of the sight pins can be positioned no closer than that allowed when adjacent internally threaded fasteners are abutted against one another. For some higher power bows, it may be necessary, in order to properly sight the bow, to position the tips of adjacent sight pins closer than is physically possible if the sight pins are maintained in a parallel relationship. One approach known in the art to allow closer arrangement of the sight pins is to provide two slots in the pin plate and two different lengths of sight pins. Longer pins are secured to a back slot and shorter pins are secured to a front slot so that the tips of the longer and shorter pins extend from the front edge of the pin plate an equal distance. Accordingly, a narrow portion of the longer, back sight pins can be fitted between the wider portion of the shorter, front sight pins utilized for attaching the front sight pins to the pin plate. With such an arrangement, the distance between tips of adjacent sight pins is thus significantly decreased.

It is also common in the art, as shown by the sight disclosed in Busch, that a sight be comprised of several individual components including a guard, a pin plate, and various adjustment mechanisms. While each of these features provide vital features to the sight, employing separate components necessarily increases the overall weight of the sight and thus the bow to which the sight is attached. In addition, an increased number of components also increases the potential for vibration of components relative to one another which can affect the accuracy of the bow and can startle game being hunted.

Sight pins are commonly comprised of an externally threaded brass pin having a small ball formed on the tip thereof. The ball is often painted to provide for better visibility of the ball. Typically, when several sight pins are employed, each ball tip is painted with a different color indicating a different yardage for the archer. Sight pins are also known in the art which include fiber optic elements for illuminating the tip of the sight pin to make the tip more visible to the archer. The fiber optic type sight pins are commonly comprised of an elongated pin providing two transversely extending bores substantially parallel to one another, with one of the bores positioned proximate the tip of the pin. A fiber optic member having ends of a greater diameter than the bores extends from the tip of the pin, through the bore at the tip, to the second bore, and through the second bore effectively forming a partial loop on one side of the pin. The ends of the fiber optic member appear illuminated when exposed to light. With both brass and fiber optic sight pins, it is often advantageous to provide pins of different widths depending on the accuracy desired or needed.

Accordingly, it would be advantageous to provide an archery bow sight formed from a single piece of material, integrally forming a pin guard, pin plate, and a windage or vertical adjustment mechanism. It would also be advantageous to provide a pin plate that maintains the sight pins in a substantially parallel arrangement. In addition, it would be advantageous to provide an archery bow sight that allows the sight pins to be pivoted relative to the pin plate in order to allow the tips of adjacent sight pins to be positioned relatively closely to one another. It would also be advantageous to provide a two headed sight pin that provides two sight pins of different widths.

SUMMARY OF THE INVENTION

It is an object of the present invention to provide an archery bow sight that integrally forms the pin guard, pin plate, and gang adjustment mechanism.

It is another object of the present invention to provide an archery bow sight that is relatively inexpensive and easy to manufacture.

It is yet another object of the present invention to provide an archery bow sight that is lightweight.

It is still another object of the present invention to provide an archery bow sight that provides both gang and individual adjustment of the sight pins.

It is another object of the present invention to provide an archery bow sight that may utilize single- or double-headed sight pins.

It is yet another object of the present invention to provide a two-headed sight pin.

It is another object of the present invention to provide a fiber optic sight pin that protects the fiber optic member from being damaged.

It is still another object of the present invention to provide an archery sight having a pin plate and sight pin arrangement that maintains the sight pins in relatively parallel relationship.

It is another object of the present invention to provide an archery sight that allows individual pivoting and adjustment of the sight pins relative to the pin plate.

It is yet another object of the present invention to provide an archery sight that reduces the risk of damage to the sight that would otherwise be caused from over tightening of the sight pins to the pin plate.

Accordingly, an archery bow sight is comprised of a pin guard, a pin plate, and a gang adjustment mechanism integrally formed into a single part. Preferably, the archery bow sight is comprised of a plastic, polycarbonate, or acrylic material. The pin plate comprises a longitudinally extending aperture to which a plurality of sight pins can be secured. In addition, the aperture is preferably defined by a longitudinally extending raised portion on a first side of the pin plate. It may also be desirable to include a longitudinally extending recessed portion on a second side of the pin plate. Each sight pin includes a transversely extending recessed portion to mate with the raised portion of the pin plate. Thus, when the sight pins are secured to the pin plate, the sight pins orient themselves substantially perpendicularly to the pin plate so that each of the sight pins are substantially aligned in parallel with the tips of each sight pin in substantial vertical alignment.

Preferably, each sight pin is comprised of an elongated member having a transversely extending bore extending therethrough positioned at a point where the bore exits within the transversely extending recessed portion. The bore may include internal threads in order to secure the sight pin to the pin plate. Likewise, a pin retaining member which may be sized to fit over the pin and which includes an internally threaded bore may be employed to secure the sight pin to the pin plate.

In another preferred embodiment, the pin plate defines a longitudinally extending recessed portion on a first side thereof and circumscribing a longitudinally extending aperture. Each sight pin includes a raised portion preferably having a width to engage the sides of the recessed portion. Accordingly, when the sight pins are secured to the pin plate, the raised portion mates with the recessed portion in a manner to orient the sight pins in a substantially parallel arrangement.

In another preferred embodiment, the sight pin of the archery sight includes two heads, with each head preferably having a different size. Thus, for a more accurate sight, the more narrow head of the sight pin may be utilized.

In still another preferred embodiment, the sight pin of the archery sight is comprised of an elongate member having two transversely extending bores therethrough. A segment of a fiber optic or other self illuminating material is looped through and between the two bores. Preferably, a fiber optic support member depends from the elongate member and is connected to the loop portion of the fiber optic segment in order to support the loop portion and help prevent the loop portion from being damaged.

In still another preferred embodiment, the pin plate may also include a slotted plate proximate the longitudinal slot of the pin plate so that when a threaded fastener is inserted through the pin plate and engaged with either the sight pin or a sight pin securing member, the head of the threaded fastener is less likely to damage the pin plate resulting from over tightening of the threaded fastener.

In another preferred embodiment, the pin plate defines a plurality of apertures, each aperture positioned for securing a sight pin thereto. With such a configuration, each sight pin may be pivoted relative to the pin plate allowing the tips of the sight pins to be positioned more closely together. This is especially helpful when the power of the bow requires the tips of the sight pins to be spaced closer together than would be allowed if the sight pins were aligned in parallel. Preferably, each aperture defines a transversely extending aperture relative to the pin plate so that the tips of the pins can be substantially vertically aligned even when the pins are pivoted relative to the pin plate. For example, when four sight pins are employed and the pins are pivoted so that the tips are positioned closely together, the outermost sight pins will need to be moved more forward in their respective apertures so that the tips of all four sight pins are substantially vertically aligned.

In yet another preferred embodiment, a windage adjustment mechanism depends from or is integrally formed with the sight guard. The windage adjustment member is preferably comprised of an elongate member having at least one longitudinally extending slot formed on a side thereof. A sight mounting bracket has a first transversely extending bore therethrough sized for receiving the elongate member and a second transversely extending bore which overlaps a portion of the first transversely extending bore. The second transversely extending bore preferably includes internal threads. An externally threaded adjustment member is seated in the longitudinally extending slot of the elongate member and is threaded through the second transversely extending bore. The elongate member also includes a seat for maintaining the head of the adjustment member relative to the elongate member. Thus, upon rotation of the adjustment member, the mounting bracket will move relative to the elongate member and thus move the sight accordingly, without causing rotation of the sight. The mounting bracket may also form a clamping structure so that when the sight is positioned relative to the mounting bracket at the desired position, the mounting bracket can be tightly clamped relative to the elongate member so that the sight will maintain its relative position.

The elongate member may also define a second longitudinally extending slot formed on the opposite side from the first longitudinally extending slot for receiving an elongate guide member. In addition, the mounting bracket may define a third transversely extending bore which partially intersects the first transversely extending bore. The elongate guide member helps to maintain the mounting bracket in relative rotational position to the elongate member.

BRIEF DESCRIPTION OF THE DRAWINGS

FIG. 8A" is a cross-sectional view of the archery sight illustrated in FIG. 8A'.

FIG. 8B" is a cross-sectional view of the windage adjustment member illustrated in FIG. 8B'.

DETAILED DESCRIPTION OF THE PREFERRED EMBODIMENTS

Figure 1:
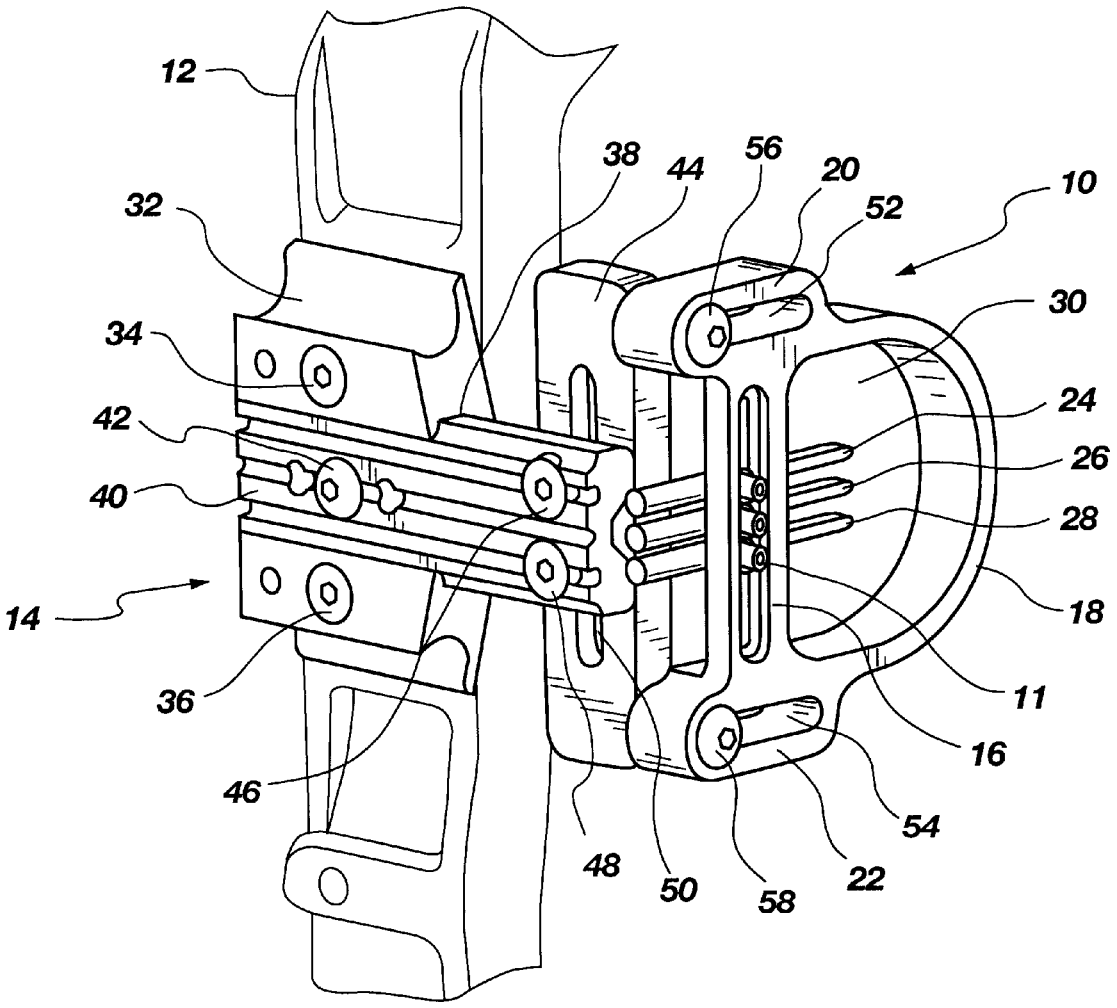
FIG. 1 is a perspective view of a first preferred embodiment of an archery sight in accordance with the present invention that is mounted to a bow.

FIG. 1 illustrates an archery bow sight, generally indicated at 10, mounted to an archery bow 12 with a mounting assembly, generally indicated at 14. The archery sight 10 is comprised of an integral pin plate 16, pin guard 18, and windage adjustment devices 20 and 22 A plurality of sight pins 24, 26, and 28 are attached to the pin plate 16 so that they extend into the sight window 30 defined by the pin guard 18 and the pin plate 16. Typically, each pin 24, 26, and 28 is positioned relative to the pin plate 16 for aiming an arrow (not shown) at a target. The pin 24 would typically be employed for aiming at closer targets while pin 28 would be employed for aiming at more distant targets.

The mounting assembly, generally indicated at 14, is comprised of a first mounting bracket 32 which is mounted to the bow 12 with fasteners 34 and 36. The first mounting bracket 32 defines a transversely extending slot 38 for receiving a second mounting bracket 40. The second mounting bracket 40 comprises an elongate member having a cross-section sized and shaped to be received and closely fitted within the slot 38. The second mounting bracket 40 is secured to the first mounting bracket 38 with fastener 42. A third mounting bracket 44 is secured to the second mounting bracket with a pair of fasteners 46 and 48 which extend at least partially through an elongate aperture 50 defined by the third mounting bracket. Because the fasteners 46 and 48 are spaced a distance less than the length of the elongate aperture 50, when the fasteners 46 and 48 are loosened, the third mounting bracket 44 can move vertically relative to the second mounting bracket 40. With the sight 10 mounted to the third mounting bracket 44, movement of the third mounting bracket 44 in a vertical direction relative to the second mounting bracket 40 results in gang adjustment of the sight pins 24, 26, and 28 in a substantially vertical direction.

The windage adjustment devices 20 and 22 are comprised of elongate apertures 52 and 54, respectively, defined by the sight 10. The elongate apertures 52 and 54 are generally aligned perpendicularly to the elongate aperture 50. A pair of fasteners 56 and 58 are inserted into the elongate apertures 52 and 54, respectively, and secured to the third mounting bracket 44. When the fasteners 56 and 58 are loosened, the sight 10 can be adjusted substantially horizontally relative to the third mounting bracket 44, providing gang windage adjustment of the sight 10 relative to the third mounting bracket 44 and thus the bow 12.

Figure 2:
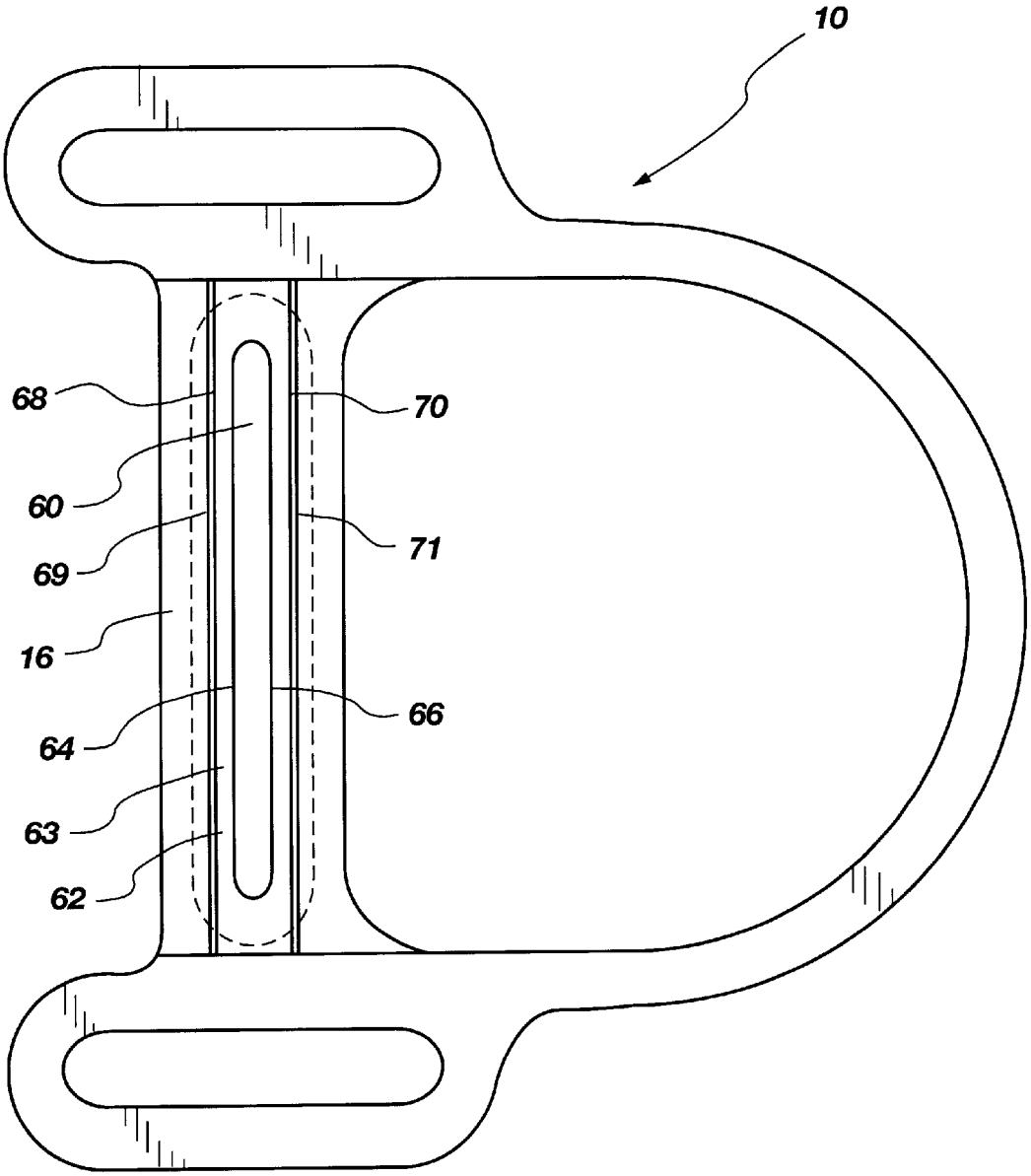
FIG. 2 is a front view of the archery sight illustrated in FIG. 1 comprising an integral pin plate, pin guard, and gang windage adjustment device in accordance with the present invention.

As further illustrated in FIG. 2, the archery sight 10 is formed from a single piece of material, preferably polycarbonate, but may also be comprised of metal, plastic, acrylic, graphite, or other materials known in the art. Polycarbonate is preferred because of its weight, durability, and manufacturability. The pin plate 16 is configured to allow positioning of sight pins relative thereto at any point along the elongate aperture 60 defined therein. In addition, the pin plate is configured to maintain sight pins secured thereto substantially perpendicularly to the elongate aperture 60 of the pin plate 16. The pin plate 16 maintains the sight pins in relative position thereto by providing a recessed or raised portion 62 that extends substantially the length of the elongate aperture 60 and extends on both sides 64 and 66 of the elongate aperture 60. The recessed or raised portion 62 defines edges or abutment surfaces 68 and 70 that are substantially parallel to one another.

Figure 2A:
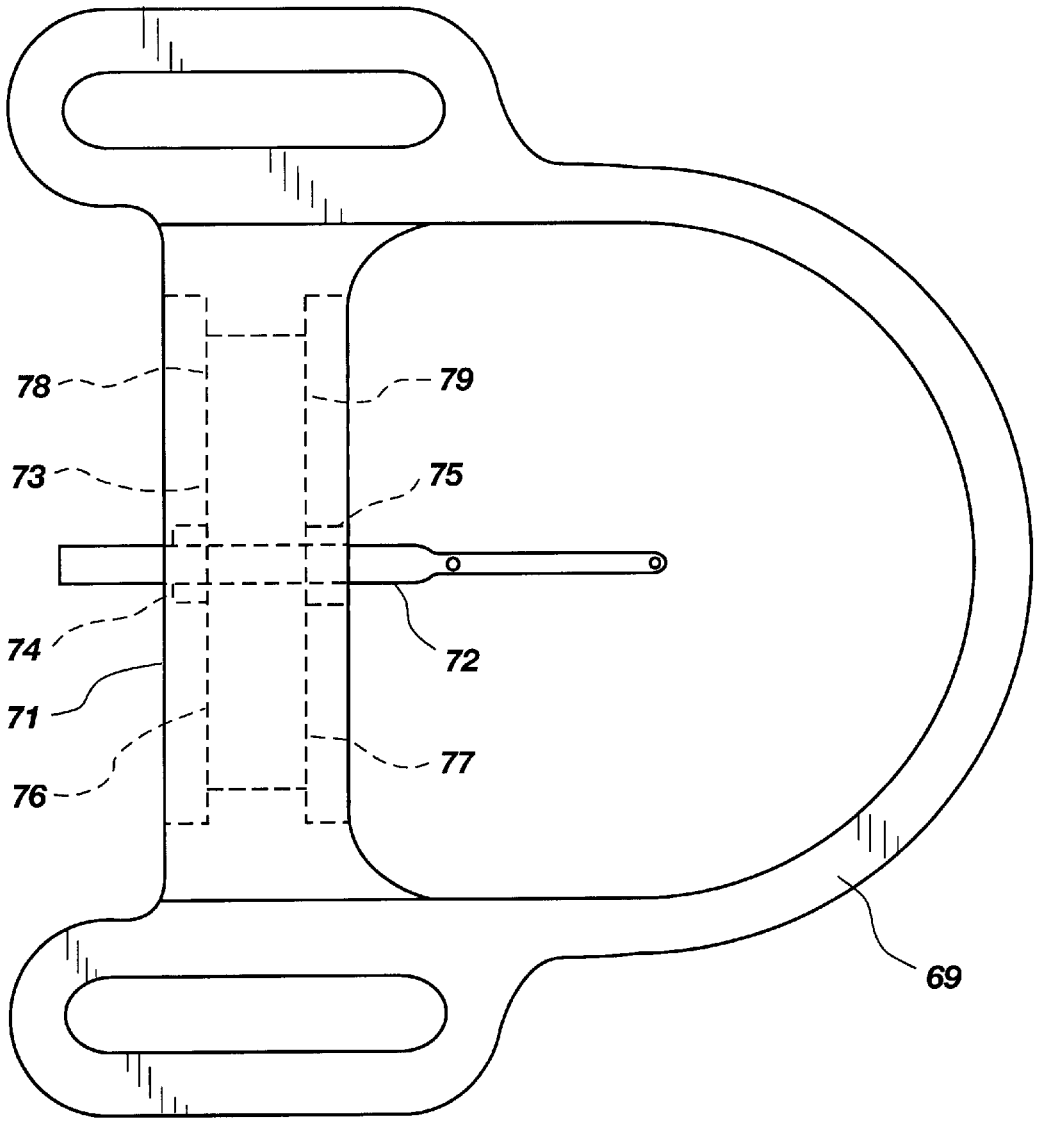

As further illustrated in FIG. 2A it is also contemplated that the pin plate 71 be oriented approximately 90 degrees from the orientation of the pin plate 16 illustrated in FIG. 2 so that the elongate aperture faces the pin guard 69. As such, a sight pin 72 would preferably be inserted through an elongate aperture 73 formed in the pin plate 71. The sight pin 72 may be secured to the pin plate 71 with internally threaded fasteners 74 and 75 that engage external threads formed on the exterior of the sight pin 72. As with the other sights herein described, the pin plate 71 may include other raised portions or recesses 76 and 77 that substantially circumscribe the aperture 76 that provide abutment surfaces or edges 78 and 79 to maintain the sight pin 72 substantially perpendicularly to the pin plate 71. Likewise, the sight pin 72 may be provided with a corresponding raised or recessed portion to mate with the pin plate 71.

Figure 3A:
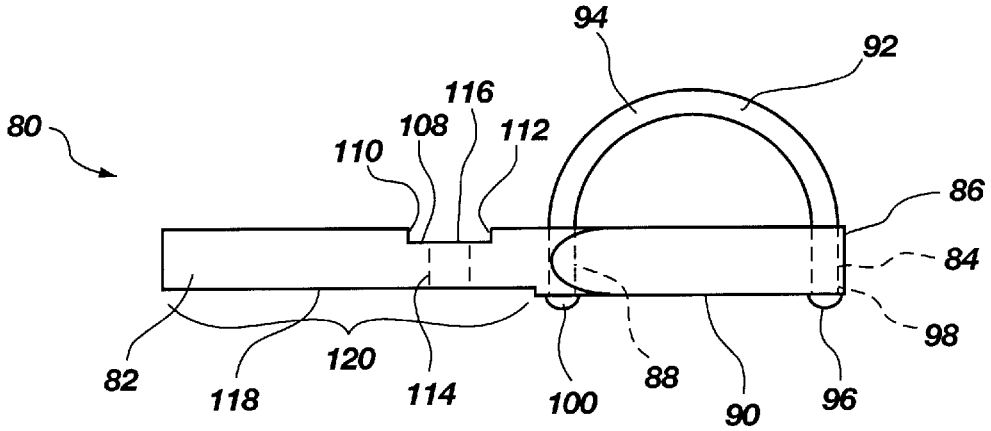
FIG. 3A is a front view of one of the sight pins illustrated in FIG. 1.
Figure 3B:
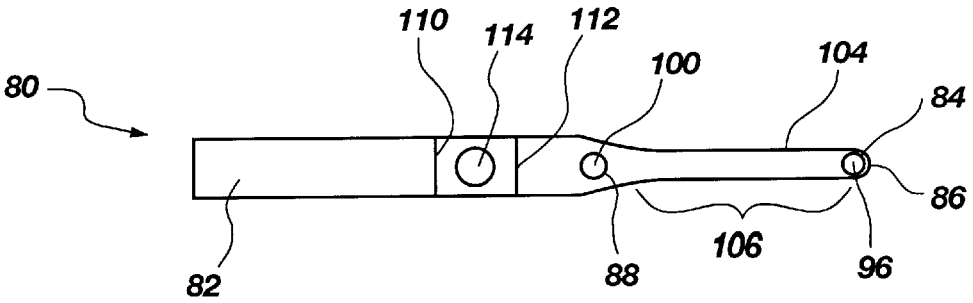
FIG. 3B is a side view of the sight pin illustrated in FIG. 3A.

Referring now to FIGS. 3A and 3B, a sight pin, generally indicated at 80, is comprised of an elongate member 82 having a first transversely extending bore 84 extending therethrough proximate the tip 86 of the sight pin 80. A second transversely extending bore 88 spaced from the first transversely extending bore 84 extends through the elongate member 82 and has a sized substantially the same as the first transversely extending bore 84. An elongate segment 92 of fiber optic material extends from a first side 90 of the elongate member 82 through the first bore 84, forms a partial loop 94, and extends through the second bore 88. The fiber optic segment 92 is retained relative to the elongate member 82 with a first head portion 96 formed on a first end 98 of the fiber optic segment 92 and a second head portion 100 formed on a second end 102 of the fiber optic segment 92.

Preferably, the distal end 104 of the elongate member 82 has a relatively more narrow portion 106 when viewed from the direction illustrated in FIG. 3B. The narrow portion 106 is desirable so that the pin sight 80 does not substantially interfere with viewing a target. When exposed to incident light, the head 96 of the fiber optic segment 92 provides an illuminated sight pin tip. Of course, the sight pin may be comprised of a more conventional sight pin having a painted tip for ease of visibility. Such sight pins are often comprised of an elongate brass member.

Figure 4A:
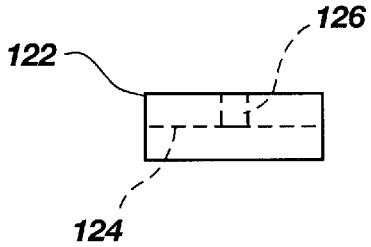
FIG. 4A is a side view of a sight pin retaining member in accordance with the present invention.
Figure 4B:
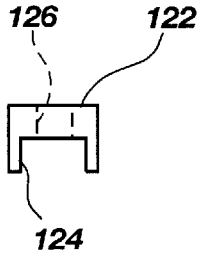
FIG. 4B is another side view of the sight pin retaining member illustrated in FIG. 4A.

The elongate member 82 defines a transversely extending slot 108 defined by a first engagement or abutment surface 110 and a second engagement or abutment surface 112. In addition, a third transversely extending bore 114 extends from the bottom surface 116 of the slot 108 to the front side 118 of the elongate member 82. The front side 118 is partially defined by a flat portion 120 which extends a length of the elongate member 82. Preferably, the distance between the first and second abutment surfaces 110 and 112 is equal to or slightly larger than the distance between the first abutment surface or edge 68 and second abutment surface or edge 70 illustrated in FIG. 2. Accordingly, the slot 108 of the sight pin 80 and the raised portion 62 of the pin plate 16 fit together in a male/female arrangement with the abutment surfaces 110 and 112 engaging the edges 68 and 70 of the pin plate 16. This arrangement will maintain the sight pin 80 substantially perpendicular to the pin plate 16. It is also contemplated that a single edge, such as edge 68 could be engageable with a single abutment surface, such as abutment surface 110 to maintain the sight pin's alignment with the pin plate 16. It is also contemplated, that the surfaces defining edges 68 and 70 may be at some angle relative to one another other than 90 degrees. For example, the surfaces 69 and 71 may be at some slope relative to a plane perpendicular to the top surface 63 of the raised portion. A fastener, such as the fastener 11 illustrated in FIG. 1, can then be employed to extend from the back of the pin plate 16 shown in FIG. 2 through the elongate aperture 60 and through the third transversely extending bore 114 illustrated in FIGS. 3A and 3B. Thus, the fastener 11 may comprise an externally threaded fastener that is threadedly engageable with internal threads provided in the internal bore 114 or engageable with an internally threaded fastener that would reside upon the front side 118. For example, an internally threaded fastener 122 illustrated in FIGS. 4A and 4B may comprise an elongate, C-shaped member defining a longitudinally extending slot 124 sized to receive the elongate member 82 illustrated in FIGS. 3A and 3B. An internally threaded bore 126 is provided to engage with an externally threaded fastener. Such an elongate internally threaded fastener 122 may be desirable to provide support over a substantial length of the elongate member 82 of FIGS. 3A and 3B to resist breaking of the elongate member 82 at the bore 114. In addition, because externally threaded fasteners, such as the fastener 11 illustrated in FIG. 1 are typically comprised of metal (e.g., steel) and the sight pins, such as sight pins 80 illustrated in FIGS. 3A and 3B are typically comprised of a softer material (e.g., plastic), it is desirable to provide an internally threaded fastener also comprised of metal rather than utilizing threads in the sight pin to avoid stripping of such internal threads. Of course, those skilled in the art will appreciate that various fastening techniques may be employed to secure the sight pin 80 to the pin plate 16 of FIG. 2.

Figure 3C:
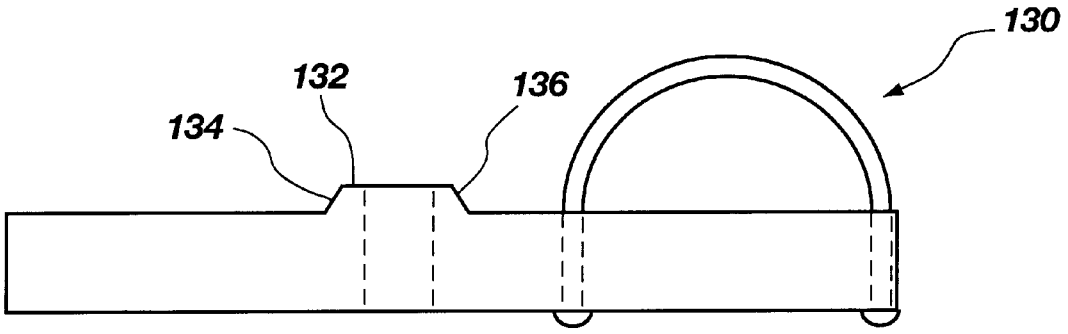

Referring to FIG. 3C, it is also contemplated that a sight pin, generally indicated at 130, may include a raised portion 132 defined by sloped sides 134 and 136 sized and shaped to mate with a recessed portion or slot formed in the pin plate. The sloped sides 134 and 136 may engage with sloped abutment surfaces defining the recess in the pin plate and may provide for a more secure fit within such a recess. Such a pin plate arrangement may look similar to the sight 10 as illustrated in FIG. 2, wherein the raised portion 62 actually defines a recessed slot having a width for receiving in a male/female relationship the raised portion 132 of the sight pin 130.

Figure 5B:
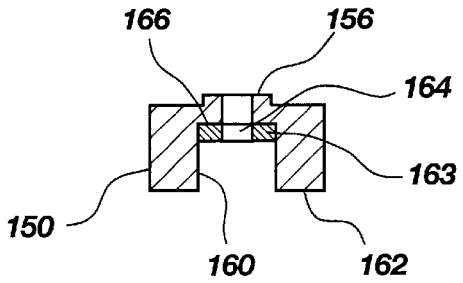
FIG. 5B is a cross-sectional side view of the pin plate illustrated in FIG. 4A.
Figure 5A:
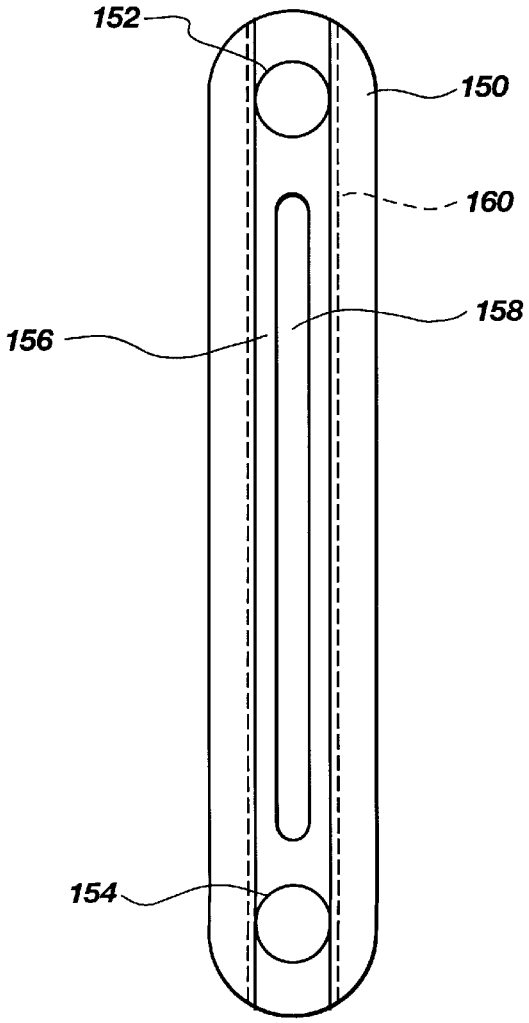
FIG. 5A is a front view of a pin plate in accordance with the present invention.

As illustrated in FIGS. 5A and 5B, a pin plate 150 may comprise a separate component provided with bores, holes, or apertures, 152 and 154 for securing the pin plate 150 to a mounting bracket or archery sight (not shown). Similar to the pin plate 16 illustrated in FIG. 2, the pin plate 150 defines a longitudinally extending raised portion 156 for maintaining a sight pin, such as the sight pin illustrated in FIGS. 3A and 3B, in relative position thereto. The pin plate 150 defines a longitudinally extending aperture 158 for securing sight pins thereto. The pin plate 150 also defines a longitudinally extending slot 160 in a back side 162 thereof substantially circumscribing the aperture 158. An insert 163 sized to fit within the slot 160 and defining a longitudinally extending aperture 166 sized to substantially match the size of the longitudinally extending aperture 158 is positioned in contact with the bottom surface 166 of the slot 160. Preferably, the insert 163 is comprised of a material that is substantially harder than the material comprising the pin plate 150, such as metal. The slot 160 is also sized to receive a head of a fastener, such as fastener 11 illustrated in FIG. 1. Because such fasteners 11 are typically comprised of metal (e.g., steel), over tightening of such fasteners 11 could cause damage to the bottom surface 166 of the slot 160 if not provided with a protective insert 163.

Figure 6:
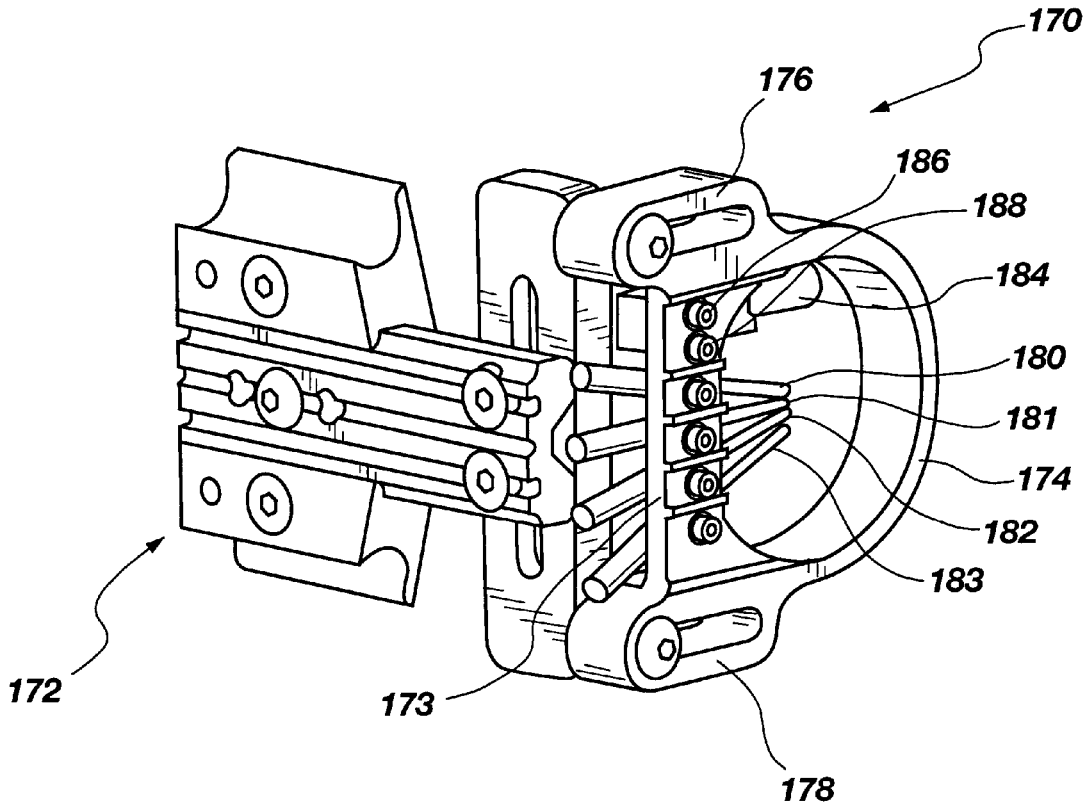
FIG. 6 is a perspective view of a second preferred embodiment of an archery sight in accordance with the present invention.

FIG. 6 illustrates another preferred embodiment of an archery sight, generally indicated at 170, in accordance with the present invention employing a similar mounting assembly, generally indicated at 172. The sight 170 is similar in configuration to the sight 10 illustrated in FIG. 1 in that the sight 170 is comprised of an integrated pin plate 173, pin guard 174, and windage adjustment devices or members 176 and 178. With the sight 170, however, the individual sight pins 180, 181, 182, and 183 can be pivoted relative to the pin plate 173 and secured thereto in a manner in which the individual sight pins 180, 181, 182, and 183 are not necessarily arranged substantially parallel to one another, such as the pin arrangement illustrated in FIG. 1. In addition, a sight level 184 may be secured to the pin plate 173 with a pair of fasteners 186 and 188.

Figure 7:
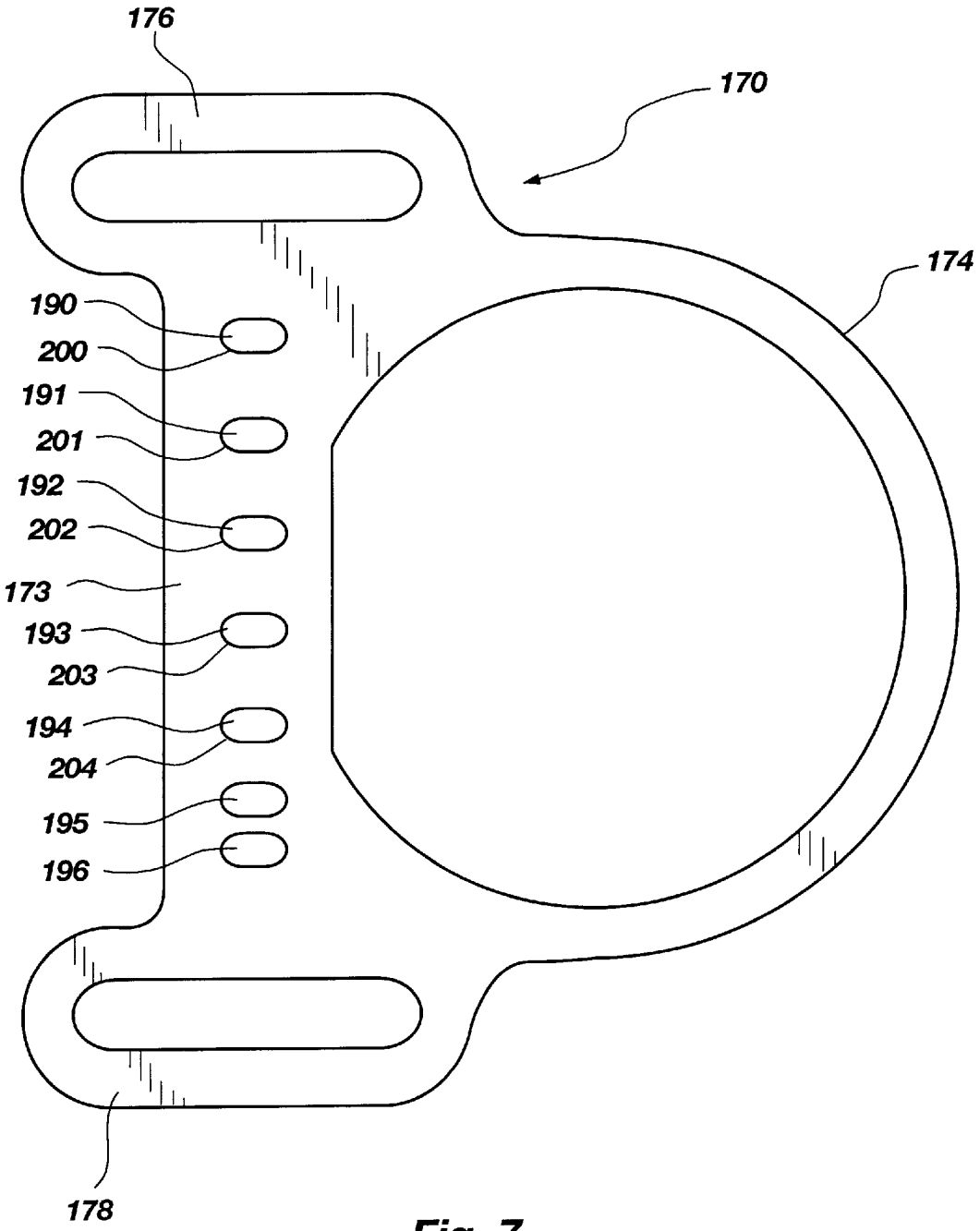
FIG. 7 is a front view of the archery sight illustrated in FIG. 6 comprising an integral pin plate, pin guard, and gang windage adjustment device.

As better illustrated in FIG. 7, the pin plate 173 of the sight 170 defines a plurality of elongate apertures 190, 191, 192, 193, 194, 195, and 196. Each aperture 190, 191, 192, 193, 194, 195, and 196 provides a point of attachment for a sight pin, such as sight pins 180, 181, 182, and 183 illustrated in FIG. 6 or the sight level also illustrated in FIG. 6. The apertures 190, 191, 192, 193, 194, 195, and 196 are preferably elongated to maintain substantially vertical alignment of the tips of the sight pins 180, 181, 182, and 183 when the tips are positioned closely together as illustrated in FIG. 6. Accordingly, those sight pins 181 and 182 closest to the center of the grouping of sight pins 180, 181, 182, and 183 may be secured closer to the proximal ends 202 and 203 of the apertures 192 and 19, respectively. Such an arrangement of apertures 190–194 and sight pins 180–183 allows the tips of the sight pins 180–183 to be positioned closely together when such a tight grouping is desired, as is often the case with more powerful bows.

Elongate apertures 195 and 196 are also provided for attaching the sight level 184 as illustrated in FIG. 6. By providing two apertures, the sight level can be pivoted to some degree in order to essentially "level the level." Leveling of the level 184 may be desirable to adjust the level 184 to an orientation that is more comfortable for the archer. Leveling the level thus allows the archer to customize the sight to his or her own shooting style.

Figure 8A:
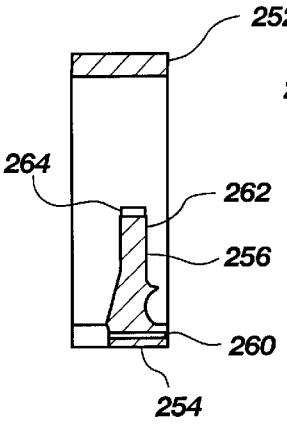
FIG. 8A' is a front view of a third preferred embodiment of an archery sight in accordance with the present invention.
Figure 8A:
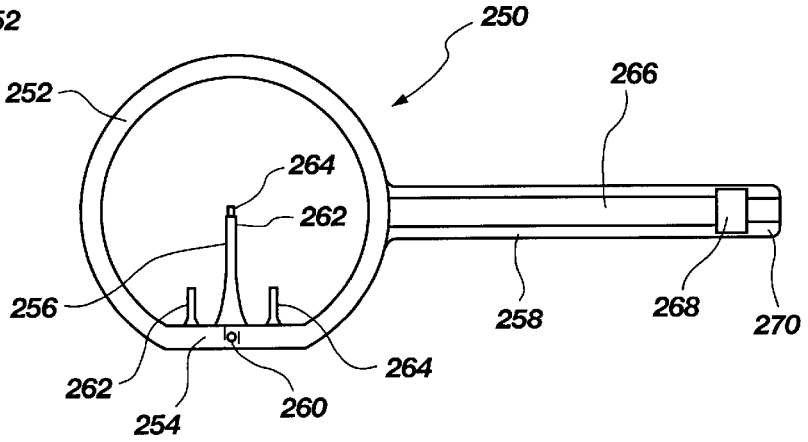

FIGS. 8A'–8C illustrate yet another preferred embodiment of an archery sight, generally indicated at 250, in accordance with the present invention. The archery sight 250 comprises an integrated pin guard 252, pin plate 254, sight pin 256, and windage adjustment member 258. The pin plate 254 defines an internal bore 260 therein for receiving one end of a fiber optic segment (not shown). Likewise, the tip 262 of the sight pin 256 is provided with an internal bore 264 for receiving the other end of a fiber optic segment (not shown). Two level retaining members 262 and 264 depend from the pin plate 254 for securing a sight level (typically a glass or clear plastic tube substantially filled with a colored liquid and having a small bubble present therein) to the pin plate 254.

Figure 8B:
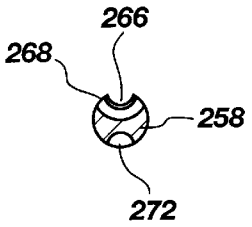
FIG. 8B'is a top view of the archery sight illustrated in FIG. 8A'.
Figure 8B:
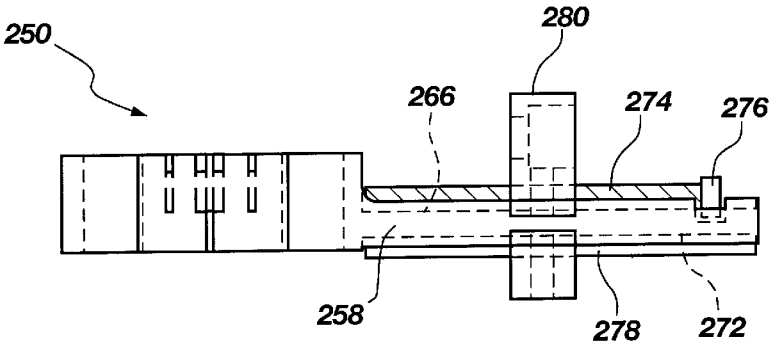

The windage adjustment member 258 is comprised of an elongate member having a first longitudinal slot 266 formed along a length thereof. In addition, a recess 268 is formed proximate the proximal end 270 of the windage adjustment member 258. As further illustrated in FIGS. 8B' and 8B", the windage adjustment member 258 defines a second longitudinal slot 272 on a substantially opposite side of the windage adjustment member 258 from the first longitudinal slot 266. An elongate, externally threaded member 274 is positioned partially within the first slot 266 with the head 276 of the externally threaded member 274 residing at least partially within the recess 268. The combined cross-section of the adjustment member 258 and the member 274 is preferably non-circular. In addition, an elongate guide member 278 is at least partially disposed in the second slot 272 further increasing the non-circularity of the combined cross-section. A sight mounting bracket 280 holds the externally threaded member 274 and the guide member 278 in their respective slots 266 and 272. Preferably, the head 276 of the externally threaded member 274 is configured to be rotated with a tool such as a wrench or screw driver.

Figure 9:
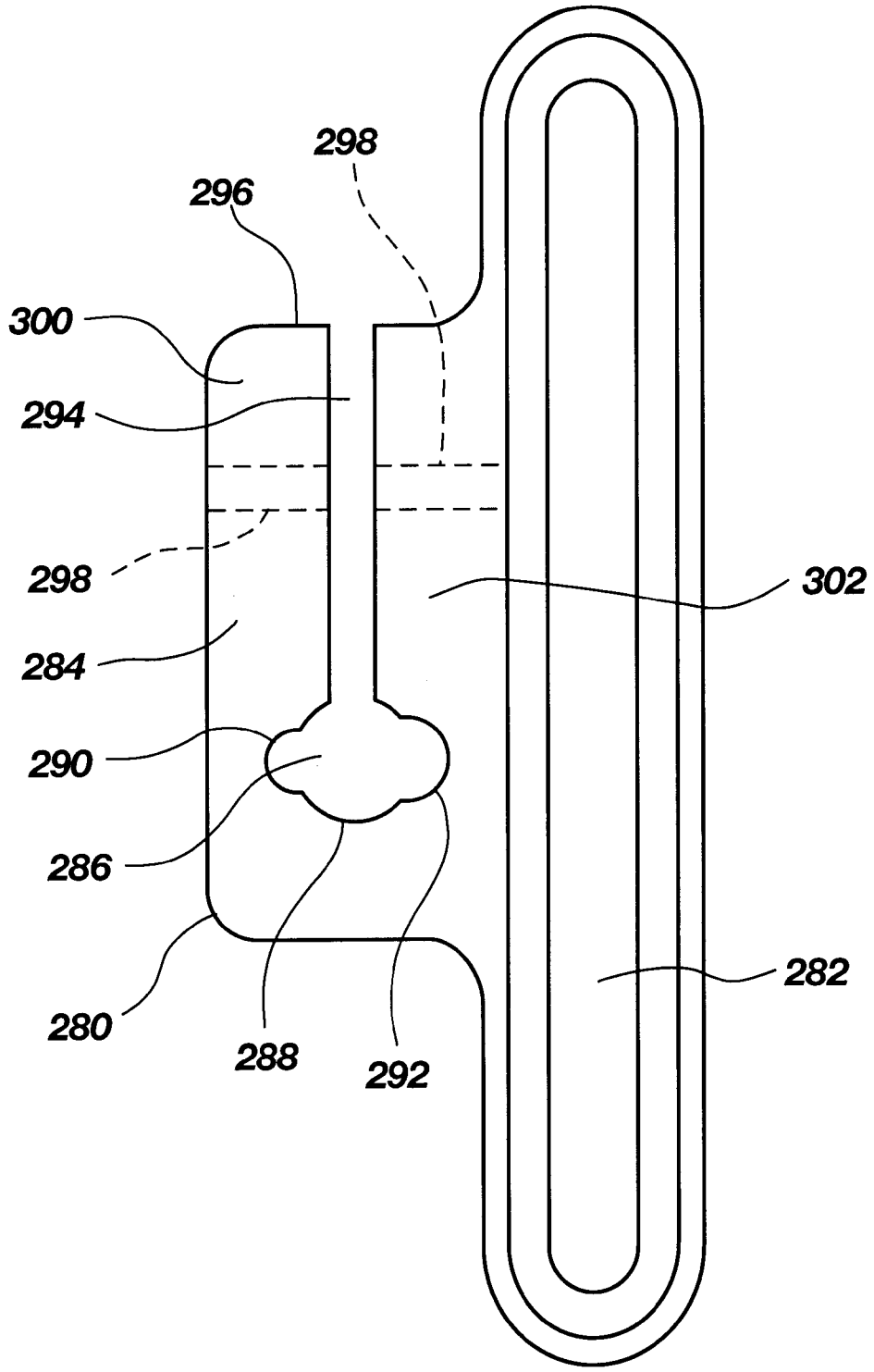
FIG. 9 is a front view of the mounting bracket illustrated in FIG. 8B.

As illustrated in FIG. 9, the sight mounting bracket 280 defines a longitudinally extending aperture 282 for mounting to a bracket such as the bracket 40 illustrated in FIG. 1. Thus, the bracket 280 will allow gang adjustment of a sight attached thereto in a substantially vertical direction. The bracket 280 also includes a clamping structure 284, in this embodiment illustrated as being comprised of a single integrated part, which defines an aperture 286 configured for receiving the windage adjustment member 258, the externally threaded member 274, and the guide member 278 illustrated in FIGS. 8A'–8C. Accordingly, the aperture 286 is defined by a first substantially circular opening 288, a second substantially circular opening 290 which overlays, is in communication with, or intersects the curved surface defining the first opening 288, and a third substantially circular opening 292 which overlays, is in communication with, or intersects the curved surface defining the first opening 288 substantially opposite from the second opening 290. An elongate slot 294 extends from an edge 296 of the clamping structure 284 to the aperture 286 and is in communication therewith. An internal bore 298 lying substantially transverse to the slot 294 extends through a first portion 300 of the clamping structure 284 and at least partially into a second portion 302 of the clamping structure 284. Preferably, at least a portion of the bore 298 in the second portion 302 is internally threaded for receiving an externally threaded fastener (not shown). In addition, the third substantially circular opening 292 is preferably threaded to match the threads of the externally threaded member 274. In operation when the clamping structure is not tightly secured relative to the windage adjustment member 258, the externally threaded member 274 may be rotated to move the sight 250 relative to the bracket 280 as the threads of the externally threaded member 274 engage the threads of the bracket 280. When the sight 250 is in a desired position, the clamping structure 284 can be secured around the windage adjustment member 258. The utilization of offset apertures and the windage adjustment member 258 prevent the sight from rotating relative to the bracket 280.

It is also contemplated that the member 274 and opening 292 may not be threaded such that the bracket 280 and components 258, 274, and 278 are slidably engageable relative to one another. With such an arrangement, the members 274 and 278 may be integrally formed with the member 258 and being present to prevent rotation of the bracket relative to the bracket 280. Accordingly, those skilled in the art will appreciate that various arrangements of guide members, circular or non-circular, and apertures, circular or non-circular, in the bracket 280 may be provided to substantially prevent rotation of the sight 250 relative to the bracket 280. In addition, while the bracket 280 is illustrated as providing a clamping structure 284, such a bracket could simply be secured relative to the member 258 with one or more set screws (not shown) as is known in the art.

Figure 8C:
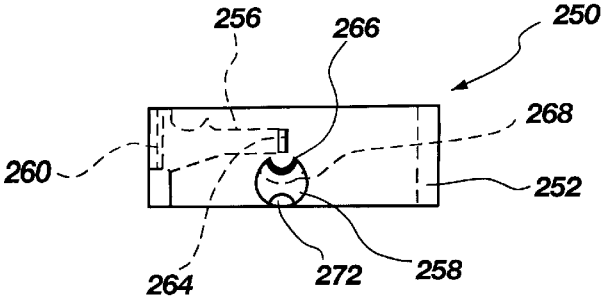
FIG. 8C is a side view of the archery sight illustrated in FIG. 8A.
Figure 10A:
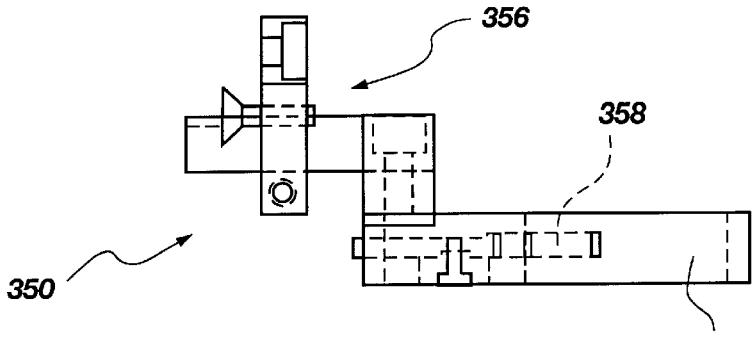
FIG. 10A is a side view of a fourth preferred embodiment of an archery sight in accordance with the present invention.
Figure 10B:
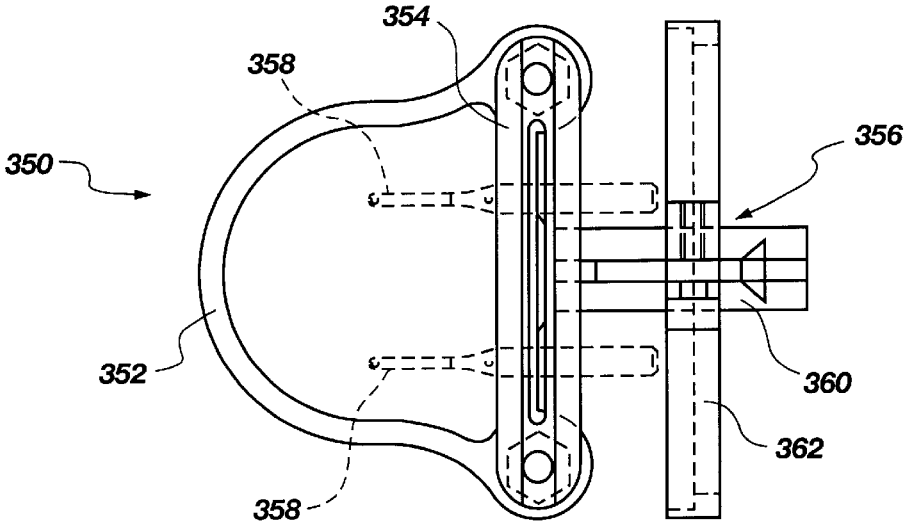
FIG. 10B is a front view of the archery sight illustrated in FIG. 10A.

While the windage adjustment mechanism is illustrated in FIGS. 8A'–8C as being an integral part of the sight, it is also contemplated that the components may be separately formed parts that may be assembled into a single sight. For example, as illustrated in FIGS. 10A and 10B, the sight, generally indicated at 350, is comprised of a sight guard 352 which is securable to a pin plate 354 which is securable to a micro-adjustable windage adjustment assembly, generally indicated at 356, which functions in a similar manner to the adjustable windage mechanism illustrated in FIGS. 8A–8C. A plurality of sight pins 358 may be secured to the pin plate 354.

Figure 10C:
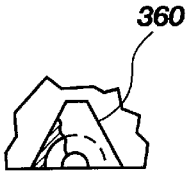

As shown in FIG 10C, the windage adjustment member 360 has non-circular cross-section to help prevent rotation of the adjustment member 360 relative to the mounting bracket 362.

Figure 10D:
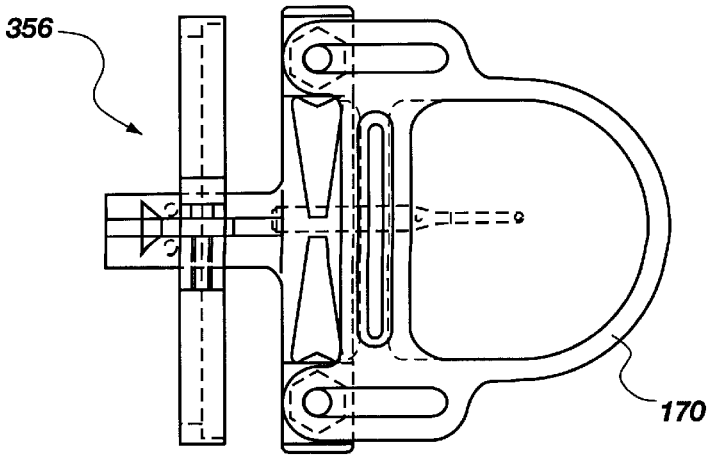

Referring to FIG. 10D, it is also contemplated that an integrated archery sight 170 could benefit from the windage adjustment mechanism 356 illustrated in FIGS. 10A–10D.

Figure 11A:
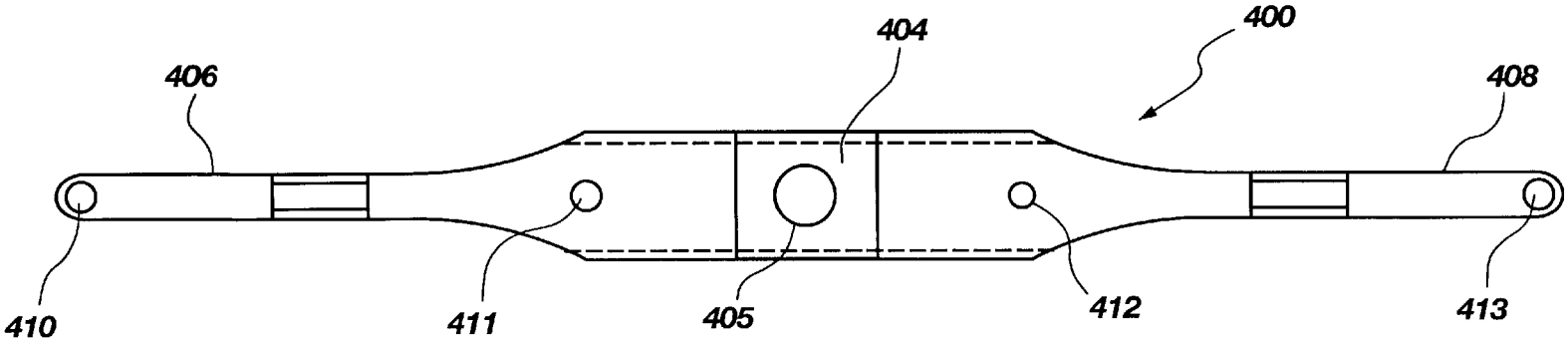
FIG. 11A is a front view of another preferred embodiment of a sight pin in accordance with the present invention.
Figure 11B:
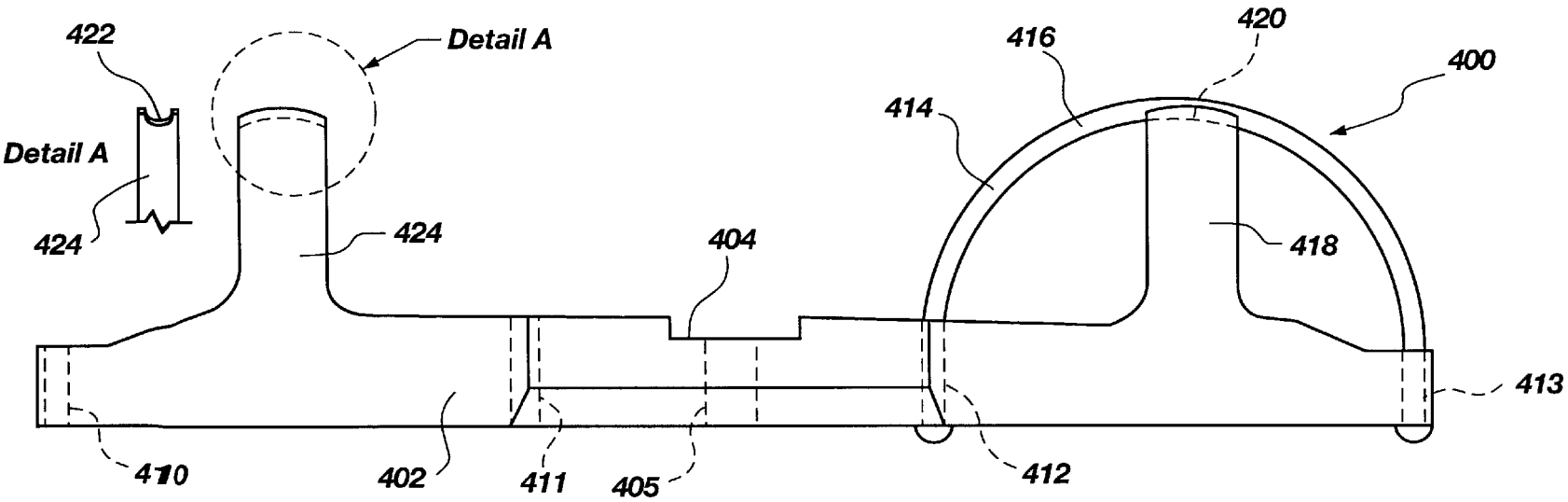
FIG. 11B is a top view of the sight pin illustrated in FIG. 10A.

In accordance with the present invention, it is also contemplated that a variety of sight pins may be employed with and benefit from the archery sights presented herein. For example, as shown in FIGS. 11A and 11B, a two headed sight pin, generally indicated at 400, is comprised of an elongate member 402 defining a transversely extending, substantially rectangular slot 404 therein proximate a mid portion of the elongate member 402. As with the sight pin 80 disclosed in FIGS. 3A and 3B, the slot 404 is configured to engage with a pin plate to help maintain the orientation of the sight pin 400 relative thereto. A pin retaining bore 405 is provided to secure the sight pin 400 to a pin plate (not shown). As shown in FIG. 11A, it is preferable that a first end 406 has a width that is greater than a width of a second end 408. Thus the same sight pin 400 may be employed for shooting at targets where accuracy is more important by employing the more narrow width end 408. While this two headed arrangement may be employed with more conventional sight pins, the sight pin 400 is provided with four bores 410, 411, 412, and 413 for receiving fiber optic segments, such as the fiber optic segment 414 shown in FIG. 11B. Because the loop portion 416 of such fiber optic segments is often susceptible to being bent resulting in breakage of the segment 414, a support post on tab 418 which depends from the elongate member 402 defines a slot 420 for receiving a portion of the fiber optic segment 414. Such a slot 422 is better illustrated in DETAIL A of tab 424. Of course, the two headed sight pin 400 would provide utility without such support tabs 418 and 424.

While the preferred embodiments presented herein have been described in detail, such embodiments are merely illustrative of archery sights and other components in accordance with the present invention. In addition, other archery sights and components could benefit from the various embodiments herein disclosed. It is thus contemplated that various modifications and combinations of the preferred embodiments by one skilled in the art may be made without departing from the spirit and scope of the present invention. Accordingly, the claims are intended to cover such modifications and combinations.

What is claimed is:

1. An archery bow sight, comprising:

a pin plate having a first side and a second side, a first end and a second end and defining at least one longitudinally extending aperture extending between said first side and said second side, said first side defining first and second longitudinally extending edges proximate and substantially parallel to said at least one longitudinally extending aperture;

a pin guard integrally formed with said pin plate extending from proximate said first end to said second end of said pin plate and defining a sight window between said pin plate and said pin guard, said sight window facing in substantially the same direction as said at least one longitudinally extending aperture;

first and second windage adjustment members integrally formed with said pin plate defining first and second windage adjustment apertures, respectively, said first and second windage adjustment apertures facing in substantially the same direction as said at least one longitudinally extending aperture;

at least one sight pin securable to said pin plate comprised of an elongate member having a front side and a back side, said back side defining a transversely extending slot, said elongate member further defining a bore extending between said first side and said second side said bore extending from said slot to said front side, said slot configured for engaging with said first and second longitudinally extending edges for maintaining said at least one sight pin in substantially perpendicular relationship to said longitudinally extending aperture; and a fastener mechanism securable to said transversely extending bore of said at least one sight pin and said pin plate for securing said at least one sight pin to said pin plate.

2. The sight of claim 1, wherein said pin guard is comprised of a substantially "C" shaped member having a first end and a second end and depending from said first windage adjustment member at said first end and depending from said second windage adjustment member at said second end.

3. The sight of claim 1, wherein said first side of said pin plate is defined by a longitudinally extending raised portion having said first longitudinally extending edge positioned on a left side of said at least one longitudinally extending aperture and said second longitudinally extending edge positioned on a right side of said at least one longitudinally extending aperture.

4. The sight of claim 3, wherein said transversely extending slot has a width at least equal to a distance between said first longitudinally extending edge and said second longitudinally extending edge.

5. The sight of claim 4, wherein said fastener mechanism comprises an externally threaded fastener having a head wherein said elongate fastener is inserted through said at least one elongate aperture with said head on said second side of said pin plate and into said bore of said at least one sight pin for securing said at least one sight pin to said pin plate.

6. The sight of claim 5, wherein said pin retaining member defines a longitudinally extending slot for receiving said at least one sight pin therein.

7. The sight of claim 1, wherein said second side of said pin plate includes a recess defined by a recessed surface circumscribing at least a portion of said at least one longitudinally extending slot.

8. The sight of claim 7, further including an elongate insert defining a longitudinally extending opening therein inserted at least partially within said recess such that said longitudinally extending opening is substantially aligned with said at least one longitudinally extending aperture for protecting said pin plate from engagement with said fastening mechanism.

9. The sight of claim 1, further including a leveling mechanism attached to said pin plate.

10. The sight of claim 5, wherein said fastener mechanism further comprises a pin retaining member wherein said elongate fastener is inserted through said at least one elongate aperture, through said bore and into said pin retaining member.

11. An archery set, comprising:

a bow;

a sight, comprising:

an integrally formed pin plate, guard, and windage adjustment structure, said pin plate defining an elongate aperture therethrough and at least one abutment edge proximate to and substantially parallel with said elongate aperture, said pin plate and guard defining a sight window;

at least one elongate member mountable to said pin plate proximate a first end, said at least one elongate member having at least one engaging surface formed thereon for engaging with said at least one abutment edge to orient said at least one elongate member substantially perpendicular to said abutment edge, and including a sight tip proximate a second end positioned to be viewable within said sight window; and a fastener mechanism securable relative to said at least one elongate member and said pin plate for securing said at least elongate member to said pin plate; and a mounting bracket securable to said windage adjustment structure for securing said sight to said bow.

12. The archery set of claim 11, wherein a second side of said pin plate defines a recess circumscribing at least a portion of said elongate aperture.

13. The archery set of claim 12, further including an insert defining an elongate opening therein positioned at least partially within said recess with said longitudinally extending opening substantially aligned with said at least one longitudinally extending aperture.

14. The archery set of claim 13, wherein said sight is comprised of plastic and said insert is comprised of metal.

15. The archery set of claim 11, wherein said bow is selected from the group comprising a compound bow and a recurve bow.

16. The archery set of claim 11, wherein said at least one abutment edge is defined by a first surface having a first edge positioned on a first side of and substantially parallel with said elongate aperture and a second edge positioned on a second side of and substantially parallel with said elongate aperture.

17. The archery set of claim 16, wherein said at least one engaging surface comprises a first engaging surface and a second engaging surface defining a transversely extending slot, said first and second engaging surfaces spaced a distance at least equal to a distance between said first and second edges.

18. The archery set of claim 16, wherein said at least one engaging surface comprises first and second engaging surfaces defining a raised portion and spaced a distance substantially equal to a distance between said first and second edges.

19. The archery set of claim 17, further including a sight pin securing mechanism comprising an elongate fastener having a head and a sight pin retaining member, said elongate fastener being insertable through said at least one elongate aperture with said head positioned proximate to a second side of said pin plate, extending through a transversely extending bore in said at least one elongate member positioned adjacent a first side of said pin plate, and securable to said pin retaining member.

20. The archery set of claim 19, wherein said pin retaining member defines a longitudinally extending slot for receiving said at least one elongate member therein.

21. The archery set of claim 11, wherein said mounting bracket is abutted against said windage adjustment structure.

22. An archery sight, comprising;

a pin plate having a first side, a second side, a first end and a second end and defining at least one longitudinally extending aperture extending between said first side and said second side, said first side of said pin plate having a longitudinally extending recess extending along a substantial portion of said longitudinally extending aperture;

at least one sight pin comprised of an elongate member having a raised portion configured to fit within said longitudinally extending recess for engaging with said longitudinally extending recess and maintaining said at least one sight pin substantially perpendicular to said pin plate;

a pin guard integrally formed with said pin plate extending from proximate said first end to said second end of said pin plate and; a windage adjustment device integrally formed with said pin guard.

* * * * *